US012195833B2

(12) United States Patent
Reetz et al.

(10) Patent No.: US 12,195,833 B2
(45) Date of Patent: Jan. 14, 2025

(54) PB FREE Cu—Zn ALLOY

(71) Applicant: OTTO FUCHS—KOMMANDITGESELLSCHAFT, Meinzerhagen (DE)

(72) Inventors: Björn Reetz, Krefeld (DE); Tileman Münch, Viersen (DE); Thomas Plett, Schmallenberg (DE)

(73) Assignee: OTTO FUCHS KOMMANDITGESELLSCHAFT, Meinzerhagen (DE)

( * ) Notice: Subject to any disclaimer, the term of this patent is extended or adjusted under 35 U.S.C. 154(b) by 0 days.

(21) Appl. No.: 17/790,947

(22) PCT Filed: Mar. 30, 2021

(86) PCT No.: PCT/EP2021/058264
§ 371 (c)(1),
(2) Date: Jul. 5, 2022

(87) PCT Pub. No.: WO2021/198236
PCT Pub. Date: Oct. 7, 2021

(65) Prior Publication Data

US 2023/0091831 A1 Mar. 23, 2023

(30) Foreign Application Priority Data

Mar. 30, 2020 (DE) ..... 20 2020 101 700.4

(51) Int. Cl.
*C22C 9/04* (2006.01)

(52) U.S. Cl.
CPC ..... *C22C 9/04* (2013.01)

(58) Field of Classification Search
None
See application file for complete search history.

(56) References Cited

U.S. PATENT DOCUMENTS

| | | | |
|---|---|---|---|
| 10,570,484 | B2 | 2/2020 | Plett et al. |
| 11,359,263 | B2 | 6/2022 | Gummert et al. |
| 11,427,890 | B2 | 8/2022 | Gummert et al. |
| 2009/0022620 | A1 | 1/2009 | Weber |

(Continued)

FOREIGN PATENT DOCUMENTS

| | | | |
|---|---|---|---|
| CN | 102851533 | A | 1/2013 |
| DE | 102005017574 | A1 | 10/2006 |

(Continued)

OTHER PUBLICATIONS

"Hardness Conversion Table—Tensile Strength, Vickers, Brinell Och Rockwell." Stal & Metaller. https://www.bbshalmstad.se/en/infocenter/hardness-conversion-table/. Accessed Jul. 12, 2023. (Year: 2023).*

(Continued)

*Primary Examiner* — Brian D Walck
(74) *Attorney, Agent, or Firm* — Polson Intellectual Property Law P.C.; Margaret Polson; Christopher Sylvain

(57) ABSTRACT

A Pb-free Cu—Zn alloy for producing alloy products used under lubricated conditions, having the following composition (data in % by weight): Cu: 57-59%, Mn: 1.7-2.7%, Al: 1.3-2.2%, Si: 0.4-1.0%, Ni: 0.4-0.85%, Fe: 0.3-0.7%, Sn: 0.15-0.4%, and the remainder being Zn together with unavoidable impurities.

13 Claims, 6 Drawing Sheets

(56) References Cited

U.S. PATENT DOCUMENTS

| | | | |
|---|---|---|---|
| 2014/0259674 | A1 | 9/2014 | Zhu et al. |
| 2016/0040269 | A1 | 2/2016 | Huettner et al. |
| 2017/0145549 | A1 | 5/2017 | Plett et al. |
| 2021/0355562 | A1 | 11/2021 | Reetz et al. |
| 2022/0136085 | A1 | 5/2022 | Reetz et al. |
| 2022/0136086 | A1 | 5/2022 | Reetz et al. |

FOREIGN PATENT DOCUMENTS

| | | | |
|---|---|---|---|
| JP | S56-127741 | A | 10/1981 |
| JP | 2002012927 | A | 1/2002 |
| JP | 2019178694 | A | 10/2019 |
| RU | 2415188 | C2 | 3/2011 |
| WO | 2014152619 | A1 | 9/2014 |

OTHER PUBLICATIONS

Thyssenkrup Materials North America. "Hardness Conversion Table." https://b2b.tkmxplus.com/resources/tools-and-calculators/hardness-conversion-table. Accessed Apr. 12, 2024. (Year: 2024).*

Examination report dated Jul. 5, 2023 in related Chinese application 202180014863.2.

International Search Report dated May 20, 2021 in parent international application PCT/EP2021/058264.

International Preliminary Report on Patentability, Chapter II, dated Jun. 21, 2022 in parent international application PCT/EP2021/058264.

Notice of refusal dated Jan. 3, 2024 in related Chinese application 202180014863.2.

Examination report dated Oct. 16, 2023 in related Chinese application 202180014863.2.

Office Action dated Sep. 18, 2024 in related Russian application 2022117029/05.

Search Report dated May 21, 2024 in related Russian application 2022117029/05.

Office Action dated May 22, 2024 in related Russian application 2022117029/05.

Office Action dated Sep. 2, 2024 in related Chinese application 202180014863.2.

"CuZn37Mn3Al2PbSi" material data sheet, Deutsches Kupferinstitut [German Copper Institute], 2005 (9 pages).

Decision On Request For Review issued Oct. 21, 2024 in related Chinese application 202180014863.2.

* cited by examiner

PB FREE Cu—Zn ALLOY

BACKGROUND

The present disclosure relates to a Pb-free Cu—Zn alloy, particularly for producing alloy products used under lubricated conditions.

The special brass CuZn37Mn3Al2PbSi (CW713R) described in the material data sheet (status 2005) of the German Copper Institute is an alloy that has been used extensively for many years and is characterized by high wear resistance and good hot workability. This material has high strength values and average machinability and has good corrosion resistance. For this reason, this alloy is used for structural parts in mechanical engineering, for synchronizer rings and valve guide tubes in automobile construction, as well as for a range of plain bearing elements and hot-pressed parts. This means that alloy products produced from this alloy are used under lubricated conditions. Possible applications include permanent immersion in oil or the supply of lubricant through channel and groove systems provided for this purpose. Synchronizer rings are found in an oil environment. The same can apply to plain bearing elements, which can, however, only be lubricated with oil. This alloy is also utilized to produce components used in hydraulics, such as distributor plates. This previously known alloy has the following composition (data in % by weight): Cu: 57.0-59.0%, Mn: 1.5-3.0%, Al: 1.3-2.3%, Si: 0.3-1.3%, and the remainder being zinc along with unavoidable impurities. Admissible admixtures are tolerated (data in % by weight): Ni: max. 1.0%, Fe: max. 1.0%, Sn: max. 0.4%, Pb: 0.2-0.8%.

As can be seen from the material description given above, this previously known alloy contains Pb. This element is responsible for machinability and, due to its incorporation in tribological layers, influences running-in behavior as well as friction and wear in sliding applications.

The special brass alloy CW713R is characterized by versatile application properties, such as high wear and cavitation resistance, compatibility with lubricants and sufficient mechanical properties, especially with regard to the strength and ductility of the alloy product. These properties also include good machinability. The element Pb is introduced into brass alloys to achieve the desired machinability.

For health reasons and because of environmental aspects, efforts have recently been made to design brass alloys without lead. If possible, efforts are made not to have to do without the properties brought about by the element Pb in the alloy.

DE 10 2005 017 574 A1 describes a wear-resistant brass alloy for synchronizer rings with an optional lead content. The composition (data in % by weight) is 57.5-59% copper, 2-3.5% manganese, 1-3% aluminum, 0.9-1.5% silicon, 0.15-0.4% iron, 0-1% lead, 0-1% nickel, 0-0.5% tin, and the remainder being zinc.

WO 2014/152619 A1 discloses a brass alloy for turbochargers with the following composition, optionally containing lead (data in % by weight): 57-60% copper, 1.5-3.0% manganese, 1.3-2.3% aluminum, 0.5-2.0% silicon, 0-1% nickel, 0-1% iron, 0-0.4% tin, 0-0.1% lead, and the remainder being zinc.

For sliding applications, JP S56-127741 A discloses a brass alloy with the following composition (data in % by weight): 54-66% copper, 1.0-5.0% manganese, 1.0-5.0% aluminum, 0.2-1.5% silicon, 0.5-4.0% nickel, 0.1-2.0% iron, 0.2-2.0% tin, and the remainder being zinc.

SUMMARY

Proceeding from this background, an aspect of the present disclosure is to provide a Pb-free Cu—Zn alloy which is fundamentally suitable for an application or use for which the CuZn37Mn3Al2PbSi alloy described above was also suitable. It would be desirable if the mechanical strength properties were even improved compared to this previously known special brass alloy, but without having to accept negative impacts in terms of cold and hot workability and machinability.

This is achieved by a Pb-free Cu—Zn alloy with the following composition (data in % by weight):

Cu: 57-59%,
Mn: 1.7-2.7%,
Al: 1.3-2.2%,
Si: 0.4-1.0%,
Ni: 0.4-0.85%,
Fe: 0.3-0.7%,
Sn: 0.15-0.4%,
remainder being Zn together with unavoidable impurities.

Unavoidable impurities in the alloy are permitted at 0.05% by weight per element, with the sum of the unavoidable impurities not exceeding 0.15% by weight.

This alloy is characterized above all by the selection of the alloying elements Ni, Fe and Sn, as well as by the claimed content of these elements in the alloy composition in relation to the other alloying elements, above all Mn, Al and Si. This balanced alloy composition ensures that the alloy product has particularly good properties in terms of cold and hot workability, machinability, strength and wear resistance, the latter especially under lubricated conditions. This result is surprising since Bi is utilized as a Pb substitute in other special brass alloys, but the alloy according to the present disclosure does not use Bi. While the previously known alloy CuZn37Mn3Al2PbSi also has good hot workability, the subject of the claimed alloy not only has particularly good hot workability, but also good cold workability. The latter was not the case with the previously known alloy. Interestingly, this alloy is suitable for producing forgings. If the forgings are then subjected to stress-relief annealing, which is carried out in a temperature range between 300° C. and 450° C., this measure can increase the content of embedded α-mixed crystals to 10-15%. In order to achieve the desired properties, annealing in a temperature range of 350 to 380° C. is sufficient in many cases. Said increased content of α-mixed crystals is the reason for the improved cold formability. Without such an annealing step, the alloy microstructure contains less than 3-5% α-mixed crystal content. The same advantages of stress-relief annealing are found also in the case of extruded products, in which case a microstructure with an α-mixed crystal content of 10-15% can also be achieved through the aforementioned thermal treatment.

The strength values achievable with this alloy and the surprisingly significantly better cavitation resistance compared to comparison alloys were not foreseeable for the people involved in the development of this alloy. The alloy products produced from the alloy according to the present disclosure by forging have a 0.2% yield strength between 330 and 350 MPa, which is significantly more than what was typically obtained with forgings of the alloy CuZn37Mn3Al2PbSi (values of 230 to 300 MPa). The tensile strength of alloy products produced from the alloy according to the present disclosure is 600 to 640 MPa. With the previously known alloy CuZn37Mn3Al2PbSi, the tensile strength values are usually between 590 and 670 MPa. Slightly higher tensile strength values can also be achieved with special treatments.

Studies have shown that the interaction of the elements Ni, Fe and Sn with each other, but also with Mn, Al and Si and in connection with the formation of intermetallic phases leads to particularly good results when the Mn content is controlled at 1.9-2.6%, the Al content at 1.4-2.1%, the Ni content at 0.45-0.75% and the Fe content at 0.3-0.6%. It has been found to be particularly suitable for the desired purpose with a special characteristic of good cold and hot workability, machinability, strength and wear resistance if the alloy composition is chosen as follows (data in % by weight):

Cu: 57.5-58.5%,
Mn: 2.0-2.5%,
Al: 1.5-2.0%,
Si: 0.50-0.70%,
Ni: 0.50-0.70%,
Fe: 0.5-0.55%,
Sn: 0.20-0.35%.

The special properties of an alloy product produced from this alloy are based on the fact that the Si content is preferably not less than the Ni content. Furthermore, the Sn content of the alloy is preferably adjusted in such a way that it is at most only 50% of the Ni content or only at most 50% of the Si content. The Ni content is preferably not less than the Si content, deviations of up to 0.075% being tolerated. The Fe content also plays a role in connection with the other elements. Preferably, the Fe content is about 0.05% to 0.1% by weight less than the Ni content.

The special properties described above of an alloy product produced from this alloy are found both in the case of forged products and in the case of extruded products.

BRIEF DESCRIPTION OF THE DRAWINGS

FIG. 1*b* transverse to the pressing direction);

(FIG. 5*a* shows the peripheral microstructure; FIG. 5*b* shows the core microstructure); FIG. 6*b* core).

DETAILED DESCRIPTION

A number of alloys from the alloy according to the present disclosure were cast, then extruded and parts thereof were subjected to a subsequent forging step. In parallel, a comparative sample of the material CW713R was produced in the same way. The following are examples of two samples according to the present disclosure with regard to their alloy composition—Samples 1 and 2—and the composition of a comparative sample (CW713R):

| | Cu | Zn | Sn | Fe | Mn | Ni | Al | Si | Pb |
|---|---|---|---|---|---|---|---|---|---|
| Sample 1 | 58.4 | remainder | 0.26 | 0.46 | 2.1 | 0.52 | 1.67 | 0.52 | 0 |
| Sample 2 | 58.0 | remainder | 0.23 | 0.46 | 2.13 | 0.54 | 1.55 | 0.6 | 0 |
| CW713R | 58.1 | remainder | 0.15 | 0.35 | 2.2 | 0.32 | 1.6 | 0.7 | 0.7 |

After casting (continuous casting), blocks were sawn and then bars with a diameter of 50 mm and a length of 20 m were pressed using the blocks. The extrusion temperature of the tested series of samples was between 685° C. and 710° C. The extrusion temperature of the described samples was about 700° C. The resulting microstructure is very homogeneous across the extruded bar, both in the longitudinal direction and in the transverse direction of the pressed bar over its entire length. The only thing that can be observed is that the grain size decreases somewhat from the start of pressing to the end of pressing, as is usually observed in extrusion. The microstructure consists almost exclusively of β-phase with embedded intermetallic compounds (mixed silicides, which are adjusted in the pressing direction). The intermetallic compound content is about 3-4%.

Figure 1A:
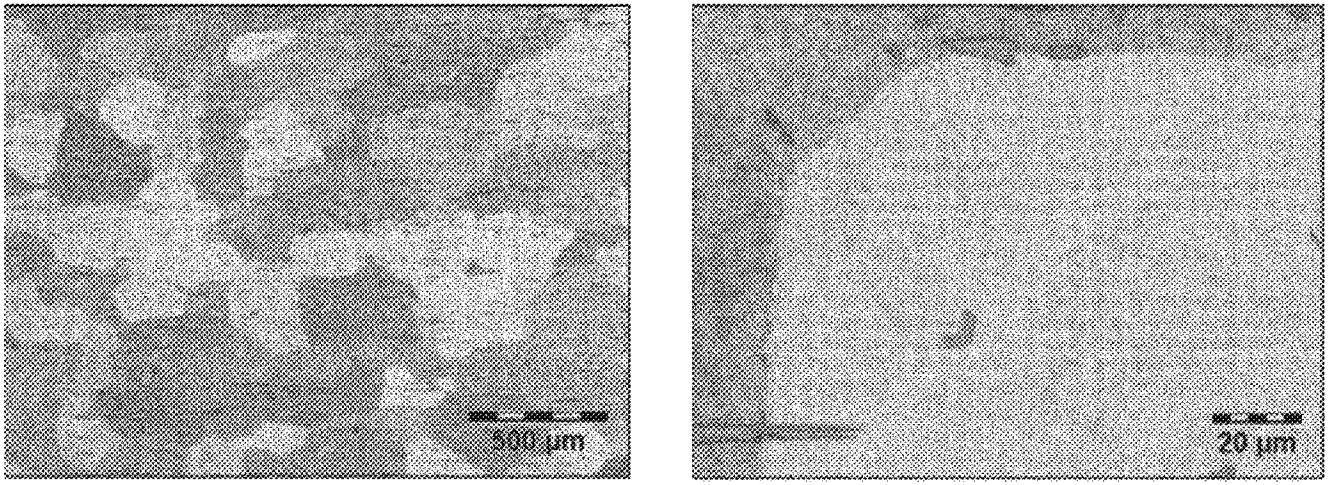
FIGS. 1*a* and 1*b* show micrographs of Sample 1 in the pressed state from the start of pressing (FIG. 1*a* along the pressing direction.
Figure 1B:
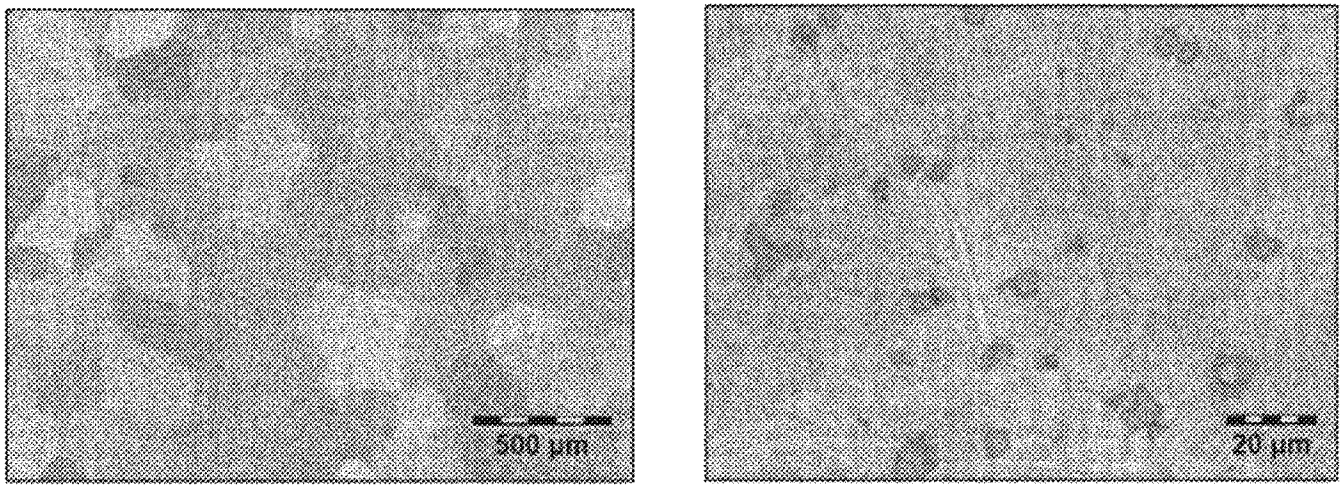
Figure 2A:
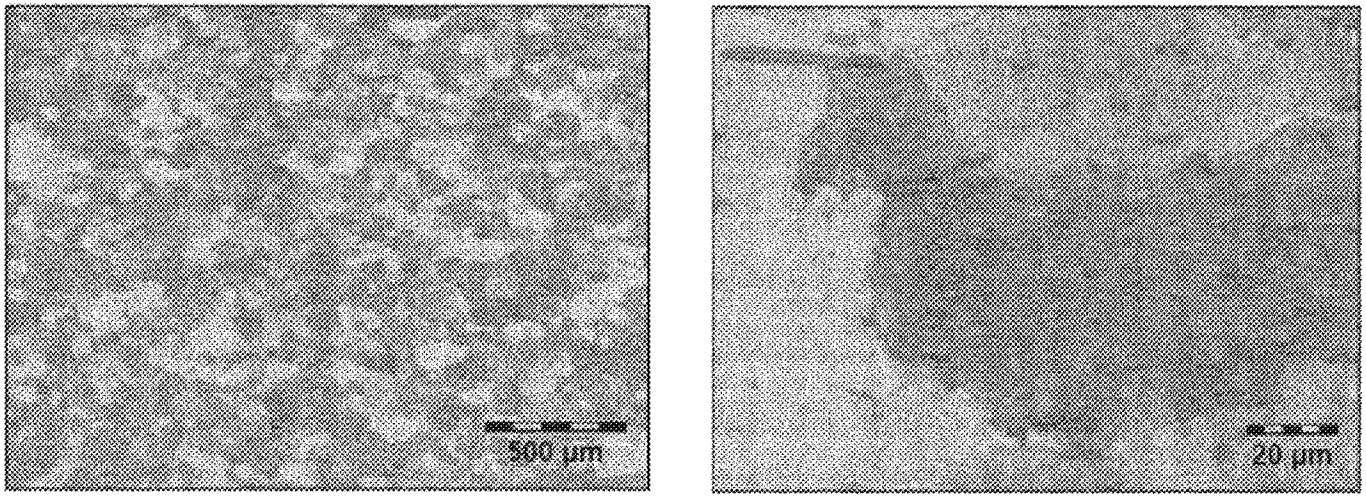
FIGS. 2*a* and 2*b* show corresponding micrographs of Sample 1 from the end of pressing.
Figure 2B:
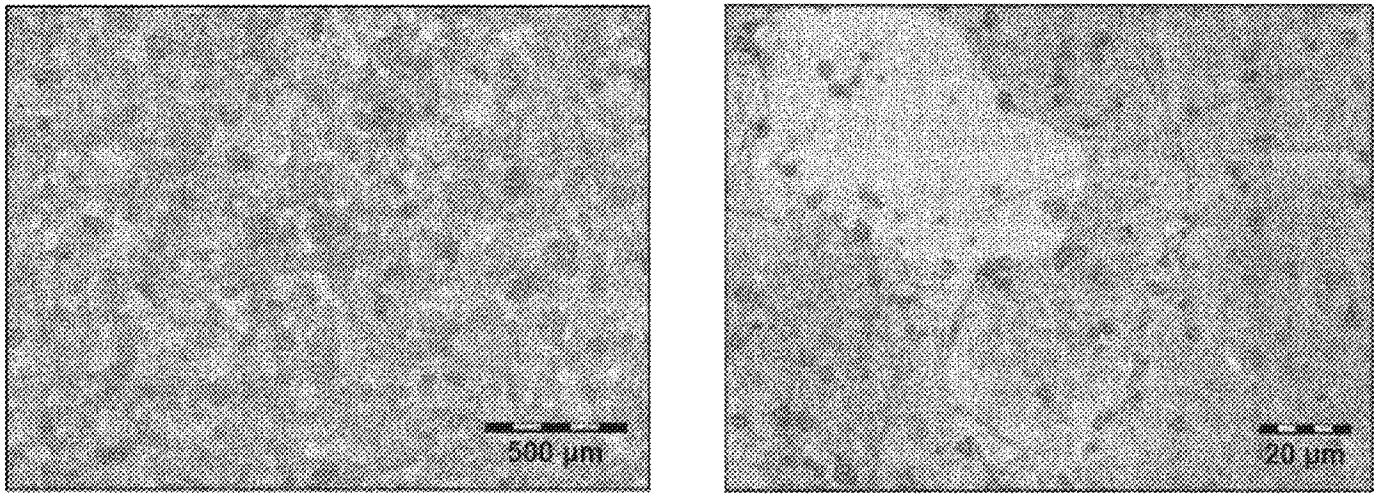

FIGS. 1*a*, 1*b* show micrographs of Sample 1 in the pressed state from the start of pressing (FIG. 1*a* along the pressing direction; FIG. 1*b* transverse to the pressing direction). FIGS. 2*a*, 2*b* show corresponding micrographs from the pressing end. In a subsequent step, the samples cut from the pressed bar were thermally stress-relieved, namely for three hours at 360° C. As a result of the stress-relief annealing, an α-mixed crystal phase was formed in the microstructure, so that a microstructure dominated by the β-mixed crystal with an α-mixed crystal content of about 14% has been formed. The intermetallic phase content is around 3%.

Figure 3A:
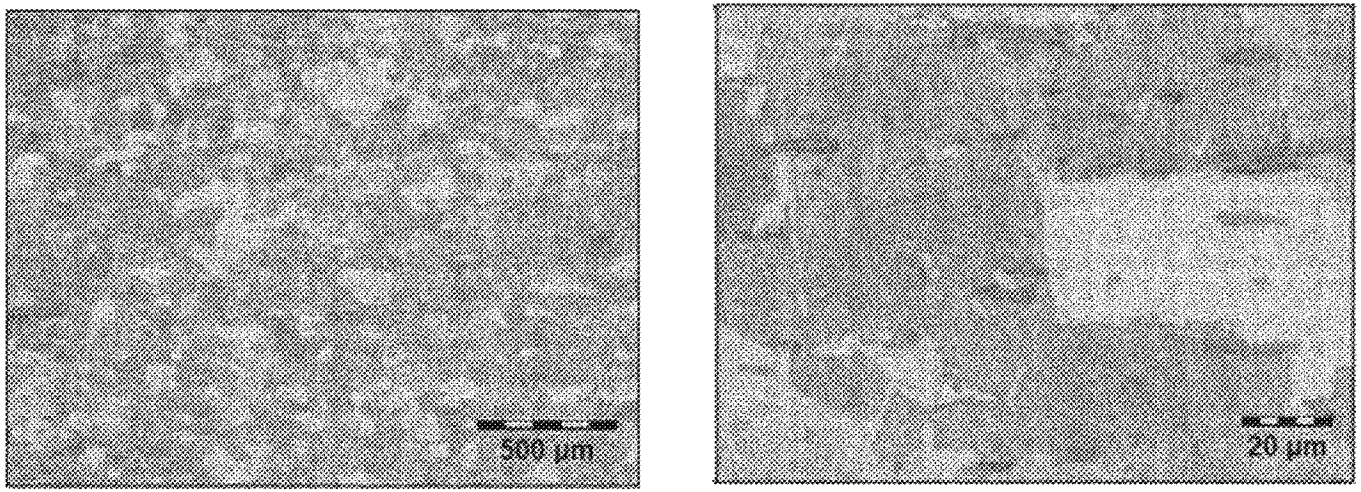
FIGS. 3*a* and 3*b* show corresponding micrographs of Sample 2 after stress-relief annealing.
Figure 3B:
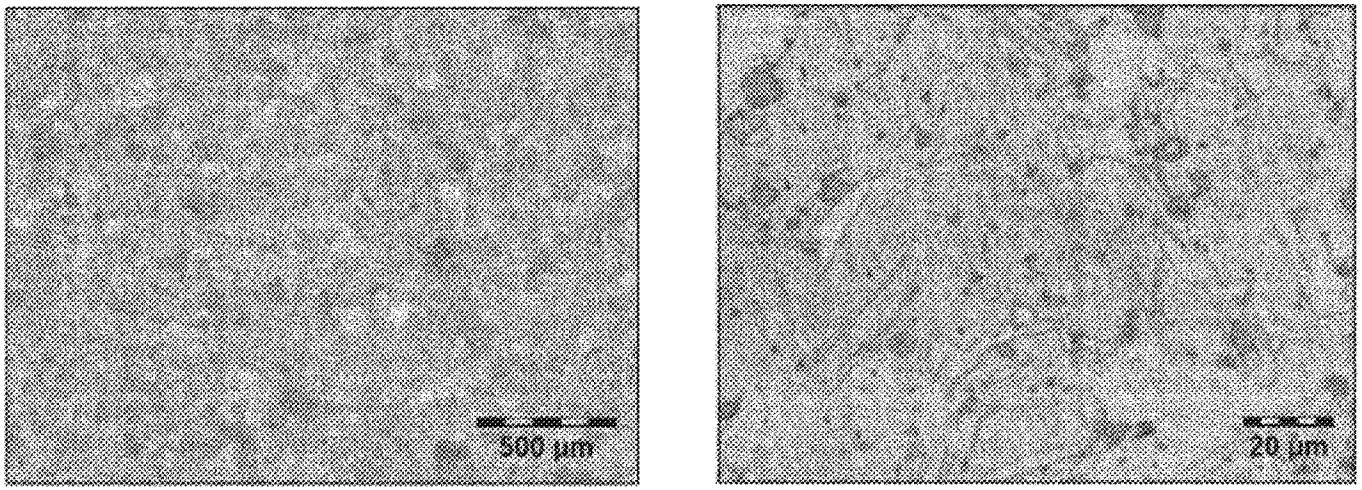

FIGS. 3*a*, 3*b* show micrographs of Sample 2 after the stress-relief annealing described above.

The microstructural parameters mentioned above and the strength values of these samples are shown in the table below:

| | State | α-content [%] | IMP content | Tensile strength [%] | Elongation at break [%] | 0.2% yield strength [MPa] | HBW |
|---|---|---|---|---|---|---|---|
| Sample 1 | pressed | <4 | 3.7 | 671 | 19.4 | 367 | 169 |
| Sample 2 | pressed and annealed | 14 | 3.1 | 649 | 22.5 | 321 | 162 |
| CW713R | pressed | 10 | 3.4 | 643 | 16 | 318 | 155 |

IMP denotes the intermetallic phases. The hardness HBW was measured as HBW 2.5/62.5.

Figure 4:
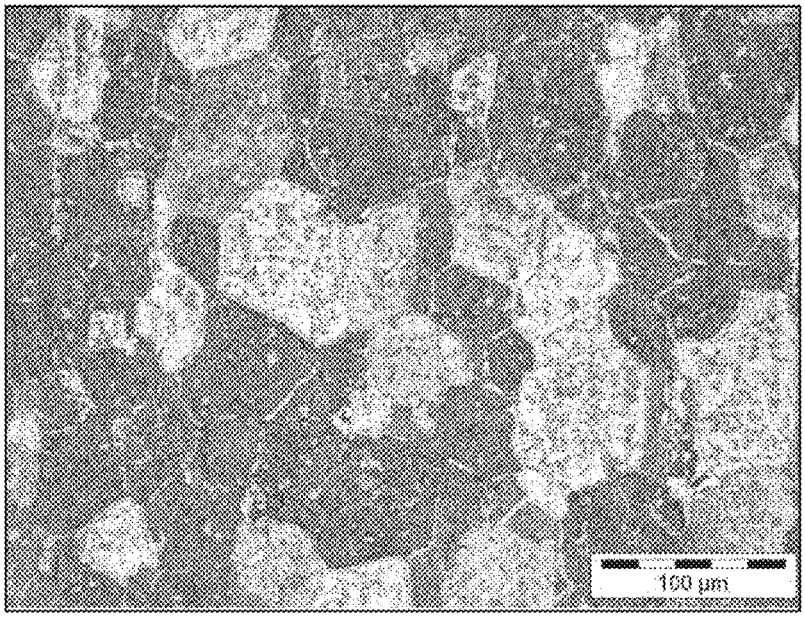
FIG. 4 shows a micrograph of Sample CW713R in the pressed state and after an annealing treatment corresponding to that of Sample 2.

The microstructure of Comparative Sample CW713R in the pressed state is dominated by the β-phase with an α-mixed crystal phase content of about 10%. The Pb contained in this alloy has a grain-refining effect and serves as a chip breaker. FIG. 4 shows a micrograph of Sample CW713R in the pressed state and after an annealing treatment, corresponding to that of Sample 2. The α-mixed crystal phase content is about 40-45%.

Figure 5A:
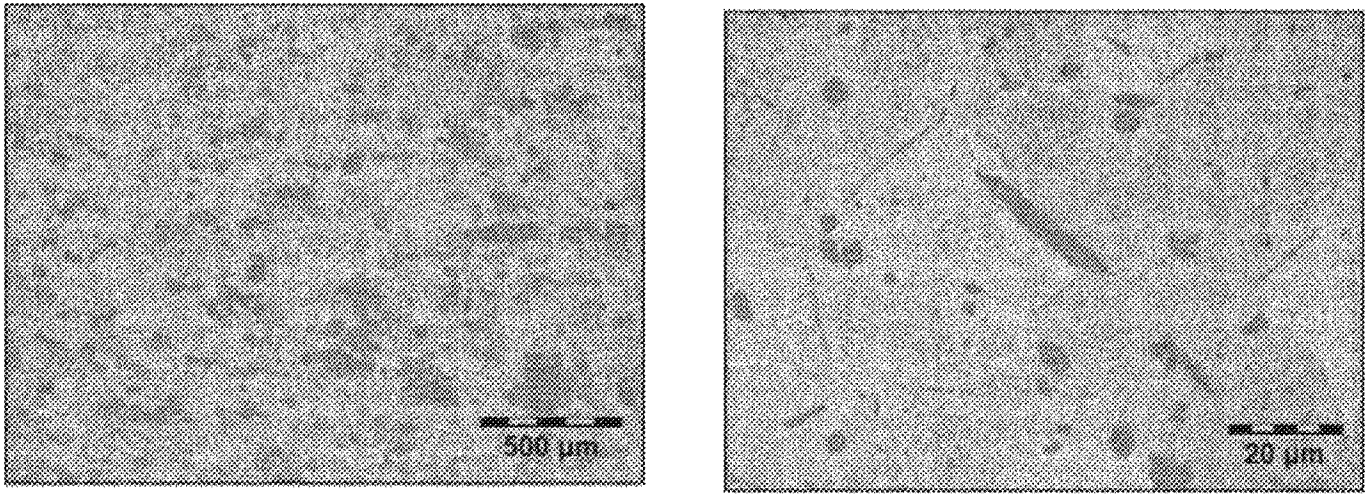
FIGS. 5*a* and 5*b* are micrographs showing the microstructure of a forged semi-finished product for a distributor plate for a hydraulic application
Figure 5B:
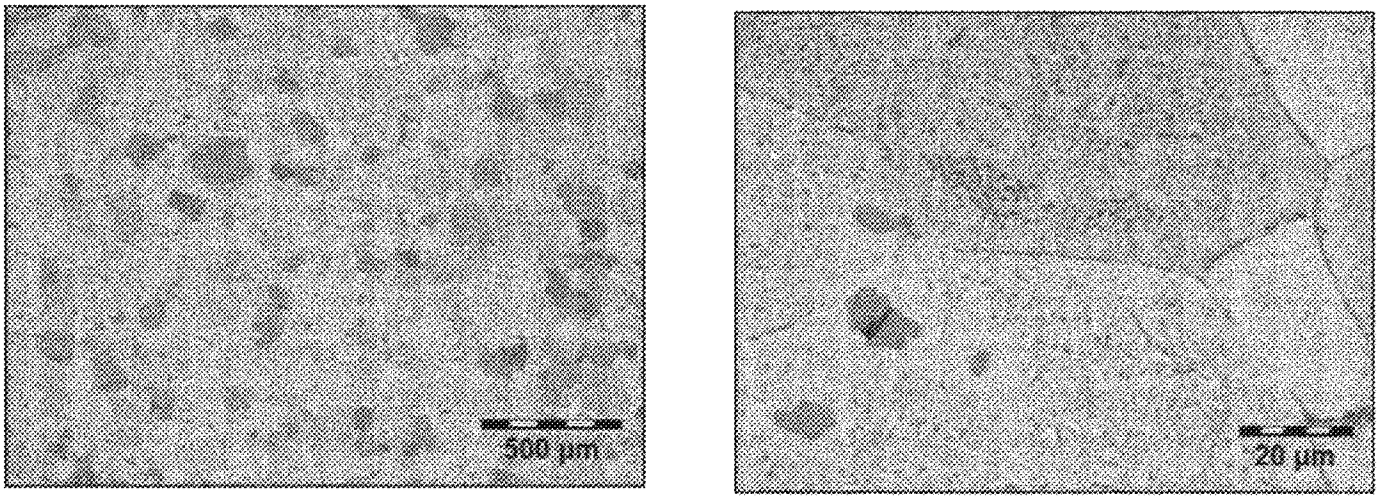

In a subsequent step for producing distributor plates, connecting pieces were separated from the pressed bars as preliminary forging products and hot-forged. The forgings in the sample series were forged at temperatures between 635° C. and 670° C. Sample 2 and the comparative sample were forged at about 650° C. The resulting microstructure of a pre-product forged in this way for a distributor plate for a hydraulic application is shown in FIGS. 5*a*, 5*b*. FIG. 5*a* shows the peripheral microstructure, while FIG. 5*b* shows the core microstructure of the forged product. These images illustrate the very homogeneous microstructure across the diameter of the forged semi-finished product. Said semi-finished product consists almost exclusively of β-phase with around 3% embedded intermetallic phases.

Figure 6A:
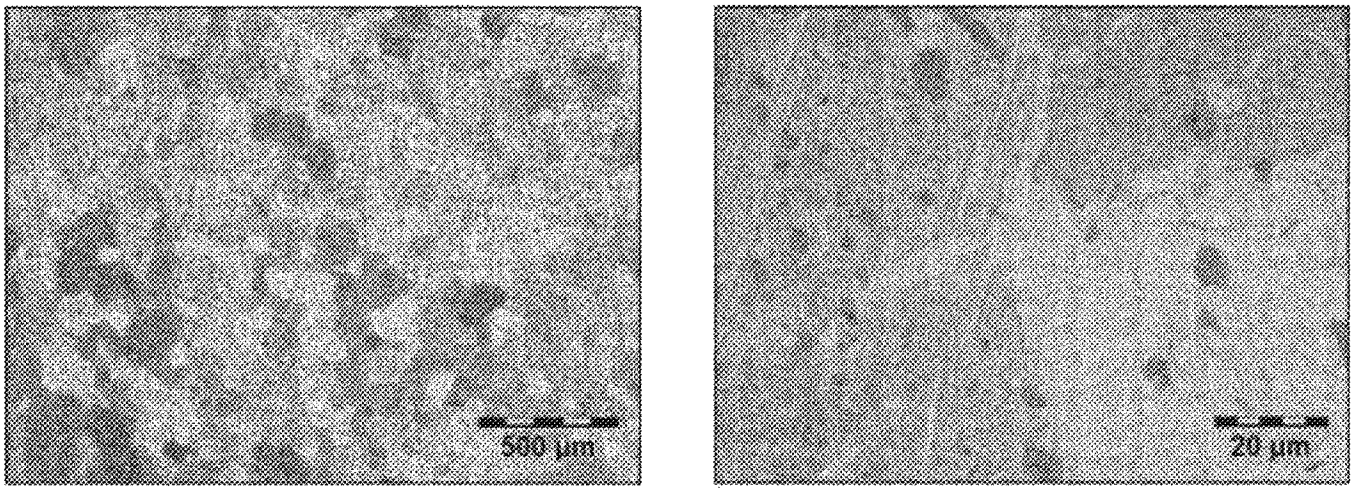
FIGS. 6*a* and 6*b* are micrographs showing the microstructure of the semi-finished product after annealing (FIG. 6*a* periphery.
Figure 6B:
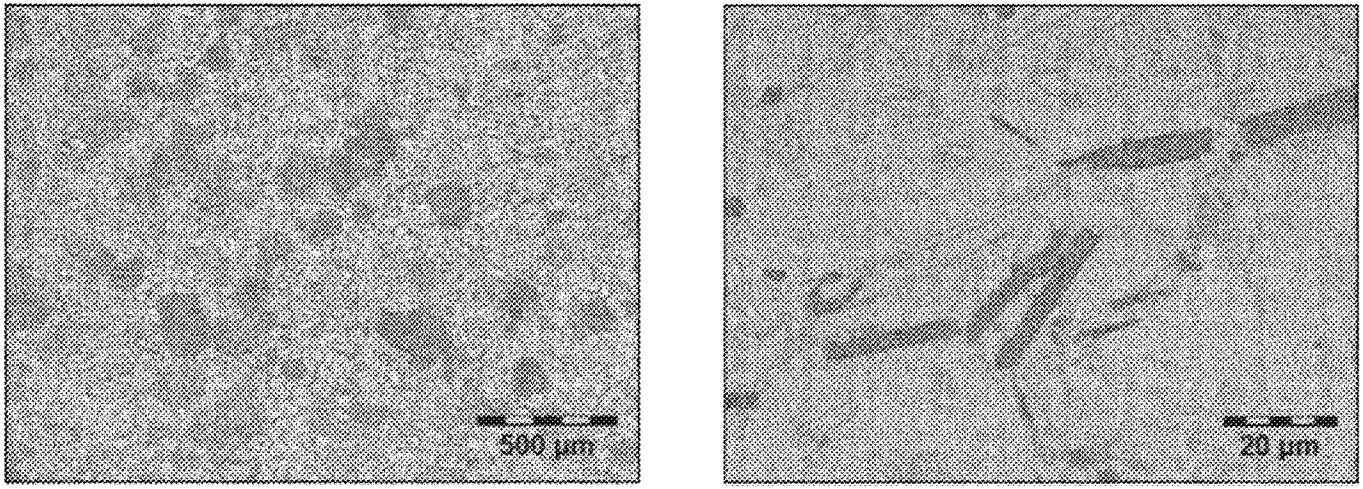

In a subsequent step, samples of this type were annealed for three hours at 360° C. In the course of this annealing process, about 12% α-phase content was formed. The intermetallic phase content increased to about 3.7%. The microstructure of the annealed semi-finished product for producing a distributor plate for hydraulic applications is shown in FIGS. 6*a*, 6*b* (FIG. 6*a* periphery; FIG. 6*b* core). The α-phase contained therein is clearly noticeable.

The microstructure parameters and the mechanical strength values for these samples are shown in the table below:

| | State | α-content [%] | IMP content | Tensile strength [%] | Elongation at break [%] | 0.2% yield strength [MPa] | HBW |
|---|---|---|---|---|---|---|---|
| Sample 2 | forged | <0.1 | 3.1 | 626 | 15.6 | 341 | 174 |
| Sample 2 | forged and annealed | 12 | 3.7 | 624 | 13.2 | 340 | 174 |
| CW713R | forged | 5 | 3.5 | 535 | 14.5 | 275 | 158 |

When the forged comparative sample (CW713R) is subjected to an annealing process as described above, the α-phase content increases significantly, up to about 40%.

Pipes were also produced from the alloy of Sample 2 and the alloy of the comparative alloy (CW713R) by extrusion. Sections were severed from the tubes which were then machined by lathing to compare the machinability of the two alloys. In the course of this lathing treatment, rings were created. Interestingly, the machinability of the ring made from the alloy according to Sample 2 is at least as good as the machinability of the ring produced from the comparison alloy. This is remarkable because the sample according to the present disclosure (sample 2), in contrast to the alloy composition of the comparative sample, does not contain any Pb, namely because the alloying element Pb in the comparative sample is held responsible for the good machinability of this alloy.

The alloy product according to the present disclosure can be drawn directly. However, an intermediate annealing prior to drawing is preferred in order to achieve as stress-free an alloy product as possible. Furthermore, additional investigations with the alloy compositions of Samples 1 and 2 for differently set material states have shown that the tensile strength Rm, the 0.2% yield strength, the elongation at break and the hardness HB also for directly drawn specimens or for specimens drawn after an intermediate annealing step were significantly enhanced compared to semi-finished products made from the comparison alloy CW713R. The same was the case with the two variants of the samples for a material state after a final stress-relief annealing. This was found in forgings produced from the alloy as well as in extruded semi-finished products that were drawn (stretched) after pressing. In both cases, subsequent annealing can be helpful to reduce the stresses in the workpiece.

Furthermore, cavitation investigations were undertaken with the forged and annealed Sample 2. For this purpose, surfaces of specimens obtained from Sample 2 were first ground with a grain size of 1000 mesh and then used for a cavitation test carried out in accordance with ASTM G32 in distilled water. It has been found that the highly rated cavitation resistance of the comparison alloy CW713R could be significantly increased once again. This reduction in the tendency to cavitation in water indicates that alloy products made from the composition according to the present disclosure have improved stability even under high dynamic load in a lubricant environment, such as occurs, for example, in cylinder liners of axial piston pumps. Such cylinder liners are made from extruded and then cold-drawn (stretched) semi-finished products. Therefore, cylinder liners for such applications are particularly suitable for production from the alloy according to the present disclosure.

The invention claimed is:

1. An alloy product for use under lubricated conditions, the alloy product produced from a Pb-free Cu—Zn alloy consisting of (data in % by weight):

Cu: 57.5-58.5%,
Mn: 2.0-2.5%,
Al: 1.5-2.0%,
Si: 0.50-0.70%,
Ni: 0.50-0.70%,
Fe: 0.35-0.55%,
Sn: 0.20-0.35%,
remainder being Zn along with unavoidable impurities;
wherein the Si content is not less than the Ni content,
wherein the Sn content is at most 50% of the Ni content and at most 50% of the Si content,
wherein the alloy product is a forged product or an extruded product, with a hardness of 160-185 HBW 2.5/62.5.

2. The alloy product of claim 1, wherein the Fe content is 0.05% to 0.1% lower than the Ni content.

3. The alloy product of claim 1, wherein the alloy product has β-microstructure and an embedded α-mixed crystal content of less than 5% and an intermetallic phase content of 2.5-4.5%.

4. The alloy product of claim 1, wherein the alloy product is thermally stress-relieved by an annealing process, and the alloy product has a β-microstructure and an embedded α-mixed crystal content of 10-30% and an intermetallic phase content of 3-5% as a result of the annealing process.

5. The alloy product of claim 4, wherein the α-mixed crystal content is 10-15%.

6. The alloy product of claim 1, wherein the hardness is 170-185 HBW 2.5/62.5.

7. The alloy product of claim 1, wherein the alloy product has a 0.2% yield strength of 300-400 MPa and a tensile strength of 600-700 MPa.

8. The alloy product of claim 7, wherein the 0.2% yield strength is 300-350 MPa and the tensile strength is 600-640 MPa.

9. The alloy product of claim 1, wherein the alloy product is a forged product with an elongation at break of 10-30%.

10. The alloy product of claim 9, wherein the elongation at break is 13-20%.

11. The alloy product of claim 1, wherein the alloy product is an extruded product with an elongation at break of 10-16%.

12. The alloy product of claim 1, wherein the alloy product has an electrical conductivity of 9-11 MS/m.

13. The alloy product of claim 12, wherein the electrical conductivity is 9.3-10.0 MS/m.

* * * * *